United States Patent [19]

Lin

[11] Patent Number: 4,875,512

[45] Date of Patent: Oct. 24, 1989

[54] FEEDER HAVING A SPEED CHANGE MECHANISM WITH A GRADUATED THREADED-SHAFT PROTECTOR

[76] Inventor: Chin-Chi Lin, No. 88, Lane 539, San Fong Rd., Fong Yuan, Taiwan

[21] Appl. No.: 309,595

[22] Filed: Feb. 9, 1989

[51] Int. Cl.[4] ..... B27B 25/00; B27C 1/12

[52] U.S. Cl. ..... 144/246 E; 144/246 R; 198/722; 198/836

[58] Field of Search ..... 198/722, 836; 144/246 R, 246 E

[56] References Cited

U.S. PATENT DOCUMENTS 3,186,455 6/1965 Stoll ..... 144/246 R 4,483,378 11/1984 Chang et al. ..... 144/246 E

*Primary Examiner*—W. Donald Bray

*Attorney, Agent, or Firm*—Christensen, O'Connor, Johnson & Kindness

[57] ABSTRACT

This invention relates to a feeder including a roller seat, a threaded control shaft which has one end protruding out from the roller seat, and an adjusting knob connected with the end of the threaded control shaft for changing the rotating speed of the conveying rollers of the feeder by means of manually rotating the adjusting knob. The protruding end of the threaded control shaft is surrounded by a sleeve member so as to protect the protruding end of the threaded control shaft from the accumulation of foreign matter. The sleeve member has predetermined graduation marks scaled on an outer surface of the sleeve member to show the rotating speed of the conveying rollers when the adjusting knob is rotated downwards and upwards.

1 Claim, 5 Drawing Sheets

FEEDER HAVING A SPEED CHANGE MECHANISM WITH A GRADUATED THREADED-SHAFT PROTECTOR

BACKGROUND OF THE INVENTION

This invention relates to a feeder, which is used on traditional wood-working machines, such as spindle modulers, circular saws, band saws, and surface planers, etc., having a speed change mechanism, and more particularly to a feeder having a speed change mechanism with a graduated threaded-shaft protector.

Referring to FIG. 1, a perspective view of a conventional feeder is shown. The feeder has a roller seat 1 in which three conveying rollers 2 are mounted. The conveying rollers 2 are driven to rotate at a constant speed by a motor 3 mounted on the roller seat 1. Such a feeder has a disadvantage in that the rotating speed of the conveying rollers 2 cannot be changed to accommodate the different kinds of wood to be handled. To solve this problem, an improved feeder with a speed change device 4 has been developed, as shown in FIG. 2. The speed change device 4 has a threaded control shaft 5 one end of which protrudes out from the roller seat 6 of the improved feeder. An adjusting knob 7 is connected with the protruding end of the threaded control shaft 5 so as that the rotating speed of the conveying rollers may be changed by manually rotating the adjusting knob 7. A speed indicating plate 8 is provided on the top of the adjusting knob 7 for showing the rotating speed of the conveying rollers. Referring to FIG. 3, the speed indicating plate 8 has a spiral line which has a plurality of numbers graduated thereon. To read the correct speed value, a user must remember the number of turns he/she has made of the adjusting knob 7 with reference to a reference mark and then compare this number with the number at the corresponding turn on the spiral line. This requires much work and is messy. In addition, foreign matter, such as wood debris, sand and dust, is likely to accumulate on the protruding end of the threaded control shaft 5, thus causing wear of said threaded control shaft 5. This wear eventually leads to both the loosening and breakage of the threaded control shaft 5.

SUMMARY OF THE INVENTION

It is therefore an object of this invention to provide a feeder in which the rotating speed value of the conveying rollers can be easily read.

Another object of this invention is to provide a feeder wherein the protruding end of the threaded control shaft is protected from the accumulation of foreign matter.

Accordingly, a feeder of this invention includes a roller seat in which a plurality of conveying rollers are mounted, a motor mounted on the roller seat for driving the conveying rollers to rotate at a certain speed, and a speed change device mounted in the roller seat. The speed change device has a threaded control shaft which has one end protruding out from the roller seat, and an adjusting knob having a bottom side connected with the end of the threaded control shaft for changing the rotating speed of the conveying rollers by means of manually rotating the adjusting knob, wherein the protruding end of the threaded control shaft is surrounded by a sleeve member, fixed on the roller seat at one end thereof, which protrudes into an annular groove extended along the bottom side of the adjusting knob so as to protect the protruding end of the threaded control shaft from the accumulation of foreign matter, the sleeve member having predetermined graduation marks scaled on an outer surface thereof to show the rotating speed of the conveying rollers when the adjusting knob is rotated downwards and upwards. Therefore, the rotating speed of the conveying rollers can be easily and directly read on the outer surface of the sleeve member.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF THE PREFERRED EMBODIMENT

Figure 1:
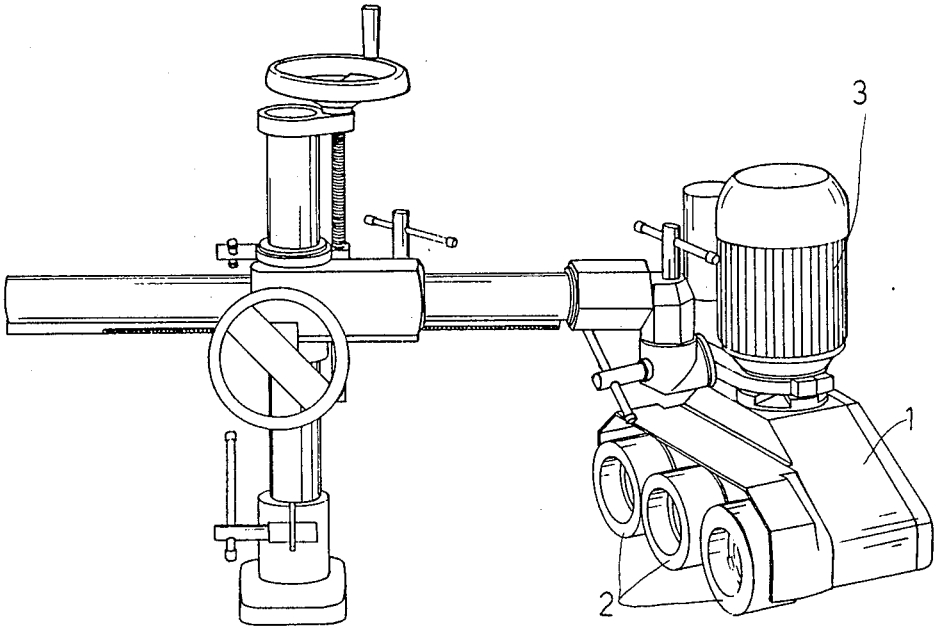
PRIOR ART FIG. 1
FIG. 1 is a perspective view of a conventional feeder.
Figure 2:
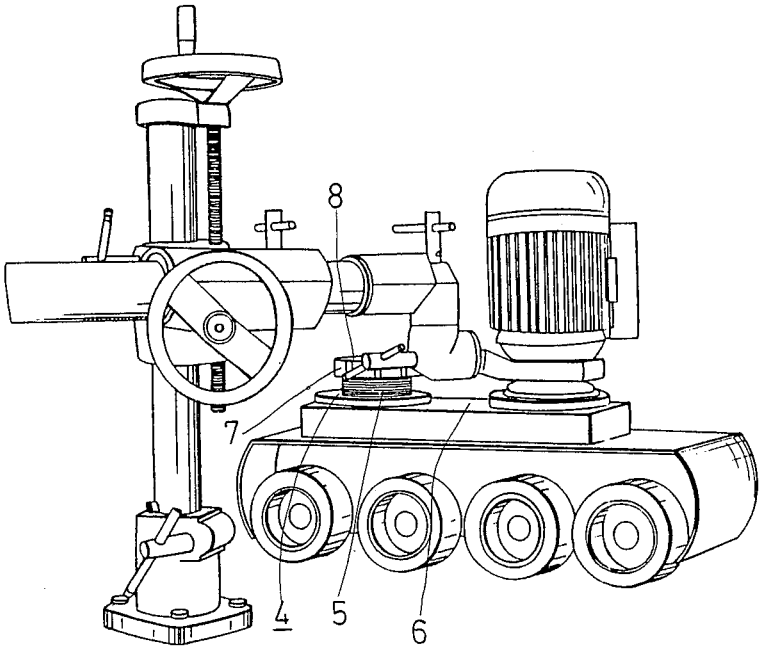
PRIOR ART FIG. 2
FIG. 2 is a perspective view of another conventional feeder having a speed change device.
Figure 3:
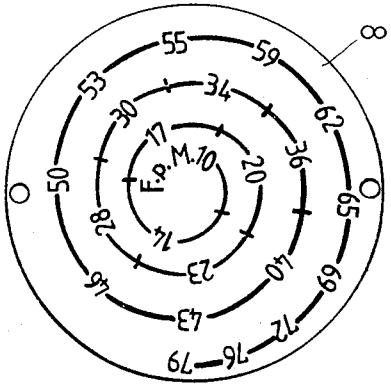
FIG. 3 is a plain view of a speed indicating plate of the conventional feeder shown in FIG. 2.
Figure 4:
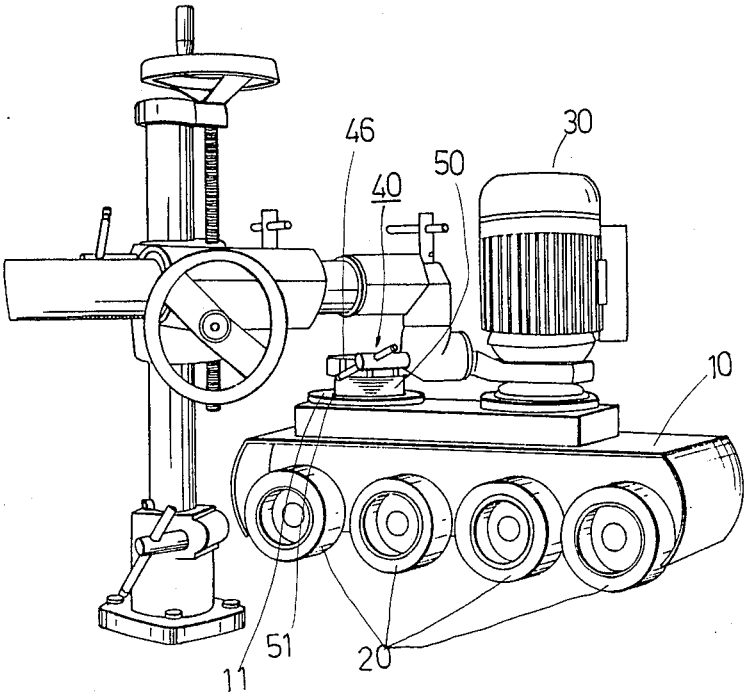
FIG. 4 is a perspective view of a preferred embodiment of a feeder of this invention.

Referring to FIG. 4, a perspective of a preferred embodiment of a feeder of this invention is shown. The feeder is used on traditional wood-working machines, such as spindle moduler, circular saws, band saws, and surface planers, etc. The feeder includes a roller seat 10 in which four conveying rollers 20 are mounted. A motor 30 is mounted on the roller seat 10 for driving the conveying rollers 20 to rotate at a certain speed. A speed change device 40 is also provided in the roller seat 10. The speed change device 40 has a threaded control shaft 45 which has one end protruding out from a projecting base 11 fixed on the the roller seat 10 (see FIG. 5). An adjusting knob 46 is connected with the end of the threaded control shaft 45 at its bottom side 461 for changing the rotating speed of the conveying rollers 20 by means of manually rotating the adjusting knob 46. A cover plate 49 marked with a fast and slow indicator is mounted on the top of the adjusting knob 46, as shown in FIG. 5.

Figure 5:
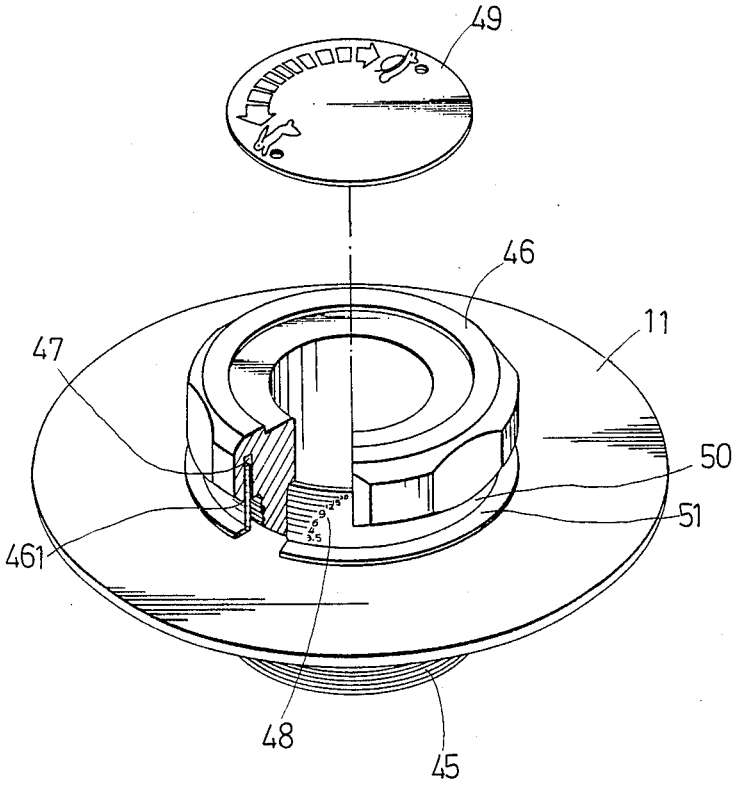
FIG. 5 is a perspective partially broken view of a threaded control shaft with an adjusting knob and a sleeve member according to this invention.

Referring to FIG. 5, the protruding end of the threaded control shaft 45 is surrounded by a sleeve member 50. A flange 51 is extended outwardly along one end of the sleeve member 50 and is fixed on the projecting base 11 of the roller seat 10. The other end of the sleeve member 50 protrudes into an annular groove 47 extended along the bottom side 461 of the adjusting knob 46 so as to protect the protruding end of the threaded control shaft 45 from the accumulation of foreign matter, such as wood debris, sand and dust. The sleeve member has predetermined graduation marks 48 scaled on an outer surface of the sleeve member 50 to show the rotating speed of the conveying rollers. When the adjusting knob 46 is rotated downwards and upwards with the threaded control shaft 45 to a certain position, the edge of the bottom side 461 of the adjusting knob 46 will remain at one of the graduated marks 48, showing a corresponding rotating speed of the conveying rollers 20. A user therefore has no need to remembering the number of turns that he/she has made of the adjusting knob 46 and compare this number with the number of corresponding turn on the spiral line, a procedure which must be followed when operating a conventional feeder. Therefore, it is easy for a user to find the correct rotating speed value of the conveying rollers 20.

With this invention thus explained, it is apparent that numerous modifications and variations can be made without departing from the scope and spirit of this invention. It is therefore intended that this invention be limited only as indicated in the appended claim.

I claim:

1. A feeder used on traditional wood-working machines, said feeder comprising a roller seat in which a plurality of conveying rollers are mounted, a motor mounted on said roller seat for driving said conveying rollers to rotate at a certain speed, and a speed change device mounted in said roller seat, said speed change device comprising a threaded control shaft which has one end thereof protruding out from said roller seat, and an adjusting knob having a bottom side connected with said end of said threaded control shaft for changing the rotating speed of said conveying rollers by manually rotating said adjusting knob, wherein the improvement is characterized in that said protruding end of said threaded control shaft is surrounded by a sleeve member fixed on said roller seat at one end thereof and protruding into an annular groove extended along said bottom side of said adjusting knob so as to protect said protruding end of said threaded control shaft from the accumulation foreign matter, said sleeve member having predetermined graduation marks scaled on an outer surface thereof to show the rotating speed of said conveying rollers when said adjusting knob is rotated downwards and upwards.

* * * * *